United States Patent [19]

Fleissner

[11] Patent Number: 4,658,512

[45] Date of Patent: Apr. 21, 1987

[54] DRYING TOWER

[75] Inventor: Gerold Fleissner, Chur, Switzerland

[73] Assignee: Vepa Aktiengesellschaft, Riehen/Basel, Switzerland

[21] Appl. No.: 652,891

[22] Filed: Sep. 21, 1984

[30] Foreign Application Priority Data

Sep. 23, 1983 [DE] Fed. Rep. of Germany ..... 3334381

[51] Int. Cl.[4] ..... F26B 13/02

[52] U.S. Cl. ..... 34/155; 34/4; 34/160; 34/219; 34/225

[58] Field of Search ..... 34/4, 39, 155, 160, 34/219, 225

[56] References Cited

U.S. PATENT DOCUMENTS

| | | | |
|---|---|---|---|
| 3,590,495 | 7/1971 | Tyson et al. | 34/48 |
| 3,900,959 | 8/1975 | Breschi et al. | 34/155 |
| 4,204,340 | 5/1980 | Doucin et al. | 34/225 |
| 4,257,172 | 3/1981 | Townsend | 34/39 |
| 4,336,279 | 6/1982 | Metzger | 34/160 |

FOREIGN PATENT DOCUMENTS 2320479 11/1974 Fed. Rep. of Germany .

*Primary Examiner*—Albert J. Makay
*Assistant Examiner*—David W. Westphal
*Attorney, Agent, or Firm*—Antonelli, Terry & Wands

[57] ABSTRACT

A predrying tower serves for heat-treating a vertically conducted length of material. In addition to infrared heating rods arranged on each side of the length of material and over the treatment height of the drying tower, respectively one air supply box is arranged bilaterally of the length of material. The air supply box extends over the height and width of the drying tower, with air slots oriented to direct air toward the length of material. In order to obtain a circulating air system, the air is exhausted above the treatment zone over the width of the length of material and conducted to a fan arranged at the end face of the drying tower, this fan blowing the treatment air downwardly in an air recycle chamber arranged likewise at the end face of the drying tower. An air ramming or air collecting chamber is arranged on the underside of the drying tower over the operating width, wherein the accelerated air is laterally introduced and exits upwardly via a heating device into the air conducting box.

20 Claims, 3 Drawing Figures

DRYING TOWER

This invention relates to a drying tower, especially a predrying tower or a hotflue construction, for the heat treatment of a vertically extending length of traveling material having a certain width, with air conducting boxes arranged on both sides of the length of material and having exhaust ports arranged to discharge in the direction toward the length of material, a radial-flow fan for recirculating the drying air being associated with these air conducting boxes.

A device having a similar type of construction is been known from DOS No. 2,320,479. For ventilating the length of material, nozzle boxes are arranged in transverse orientation on both sides—offset with respect to each other in succession—these nozzle boxes have their blast ports on the lateral end face of the tower. A radial-flow fan, the axis of rotation of which is aligned perpendicularly to the length of material, is associated with each nozzle box group and serves for circulating the treatment air. The treatment air is recycled by way of ducts disposed in parallel to the nozzle boxes so that there is, therefore, a specific air cycle for each fan. The motors for driving the fans are in all cases located on the side where the nozzle boxes are provided for the other side of the length of material. In this way, the drying tower has a narrow construction, even though the drying tower has a very great width due to the orientation of the fans with their axis perpendicularly to the length of material.

Drying towers are generally required only for predrying a textile material provided, for example, with a dye liquor so that the length of material, during the initial drying operation, no longer comes in contact with any guide elements. Thus, a drying tower is set up, for example, above a dye padder, the length of material traveling upwardly directly into the drying tower from the final guide or squeeze roller of the padder. The purpose of such a predrying tower is to achieve rapid heating and evaporation of the liquid applied by the padder. Ventilation merely by means of nozzles is inadequate therefor.

There are also lengths of material which are not air-permeable so that generally infrared drying towers are built for the predrying operation. In these towers, a plurality of infrared heating rods arranged over the height of the drying tower serves for heating the length of material, thus to evaporate the liquid adhering thereto; these heating rods with high radiation energy, effect rapid vaporization of the liquid on the length of material without having to ventilate the length of material during this operation. However, a satisfactory drying procedure is only obtained if the evaporated liquid, impeding further penetration of radiation, is also continuously removed, namely without cooling the material during such step. For this purpose, air movement in parallel to the surface of the length of material is necessary, and a construction in accordance with DOS No. 2,320,479 is not practical therefor. In a predrying tower, an intense nozzle effect, leading to fluttering of the length of material, must be avoided at any cost. Predrying is to be performed by the radiant energy of the infrared heating rods, rather than by the air.

An objective of the present invention is to provide a drying tower for predrying a length of textile or like materials including sheets, webs, bands, mats, fleeces, as well as a plurality of parallel threads, yarns, etc., wherein, in addition to the provision of radiant heating elements, a recirculating air system is furthermore provided which ensures the rapid evacuation of the heated-up moist air without imparting a fluttering motion to the length of material. At the same time, the external structure of the drying tower is not to be much deeper than necessary for accommodating the infrared heating rods and an air supply, so that several such drying towers can be set up immediately adjacent to each other, without motors, fan boxes, or the like, presenting obstacles. Finally, a construction is to be found making it possible, besides providing a beneficial energy balance, to have a minimum external surface area of the drying tower and yet to afford rapid heating up of the length of material and quick removal of the evaporated liquid.

In order to attain this objective, the invention provides a drying tower wherein, in combination, (a) infrared heating rods are arranged on both sides of the length of material over the height of the drying tower;

(b) only one air conducting box extends on each side of the length of material over the treatment height of the tower;

(c) each, respective air conducting box also extends over the treatment width for the material within the tower;

(d) each air conducting box has a dry air inlet port on the underside;

(e) above the treatment height of the air conducting boxes, an air exhaust chamber is located, this chamber is associated at an end face thereof with;

(f) a radial-flow fan with an axis of rotation in parallel to the length of material, in a fan chamber; and (g) the fan chamber is arranged outside of the treatment width in an air recycle chamber provided at the end face of the drying tower and extending over the height of the tower.

Thus, besides the construction for recirculating the drying air serving for removal of the moist air, the infrared heating rods are likewise arranged in the drying tower in this structure, transversely across the width of the panel of material on both sides of the panel of material. On account of this construction, the device is only a little deeper than is precisely required for heating up the length of material by means of the infrared heating rods. The greater depth is solely provided for the air supply boxes required on both sides. Recycling of the treatment air accelerated by the fans takes place at the end faces of the drying tower laterally of the width of the panel of material so that the depth of the drying tower need only be as wide as each fan diameter, taking into account, of course, the air volume that must be accommodated by the air conducting box on the respective side of the panel of material.

It is expedient for adequate ventilation of the length of material with recirculated air to associate the air exhaust chamber on both end faces of the drying tower with respectively one fan, these fans then blowing the treatment air on both end faces downwardly along the air recycle chambers and conducting this air at the bottom to a ramming chamber arranged over the width of the length of material in the zone of the inlet to the drying tower. From there, the air is distributed via a screen cover arranged at the location through a heating device disposed in parallel to the length of material, after which then the air conducting box extends upwardly in a conical taper.

The structure of the drying tower according to the invention will be further understood from the following description and the accompanying drawings. Still further details will be explained with reference to this embodiment, which details are also of significance in conjunction with the features of the basic invention. In the drawings.

Figure 1:
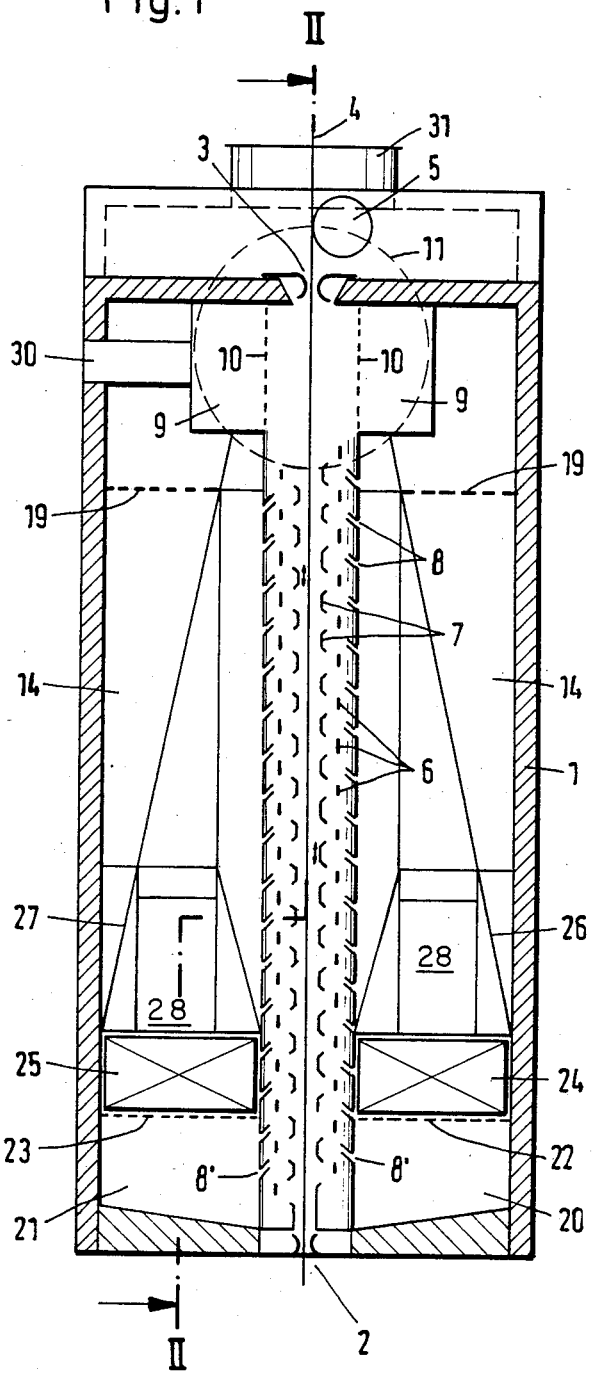
FIG. 1 shows an infrared drying tower in a sectional view, seen from an end face.

The vertically erected drying tower has a housing 1, insulated all around, having on the underside or bottom an inlet slot 2 and vertically thereabove an outlet slot 3. The moving length 4 of material comes from a padder arranged underneath the drying tower (not shown), and is transported above the tower along the guide roller 5 to a subsequent treatment unit, such as, for example, another drying tower (not shown).

Along the route from inlet 2 to outlet 3, the length 4 of material is dried on both sides with radiant energy and, in part, also by means of a convection heating system. Infrared heating rods 6 arranged in spaced-apart relationship are responsible for the radiant energy; sufficient space is left between these rods and the length 4 of material to be able to shift shielding troughs or plates 7 in front of the infrared heating rods 6. With a continuously fed length of material, the shielding troughs 7 are arranged in a staggered relationship to the superimposed infrared heating rods 6; whereas, with the length 4 of material being at a standstill, the troughs 7 are shifted in front of the heating rods 6 and thus the length 4 of material is protected from being overheated by the infrared rays.

For the removal of the moist air produced by the radiant energy along the surface of the length 4 of material, a drying air circulating system is employed. The drying air, heated up to prevent cooling of the length 4 of material, passes, via slots 8 arranged horizontally in parallel to the width of the length 4 of material and being inclined upwardly in the direction of transportation of the material, to direct the drying air in between the infrared heating rods 6 and thereafter between the, respectively provided, shielding troughs 7 and then obliquely onto the length 4 of material. By alignment of the slots 8 upwardly in the transporting direction of the length of material, an upwardly oriented air flow is generated on the panel of material, taking care of the rapid removal of the produced steam layer.

Above the final infrared heating rods 6 within the drying tower, one air exhaust chamber 9 with a fresh air feed pipe 30 is provided to the right and another air exhaust chamber 9 is provided to the left of the panel 4 of material, each chamber being separated by a screen cover 10 from the treatment zone of the drying tower. The essential recirculating air is exhausted through each air exhaust chamber 9 since the material outlet slot 3 is narrowly restricted by baffles 40.

Figure 2:
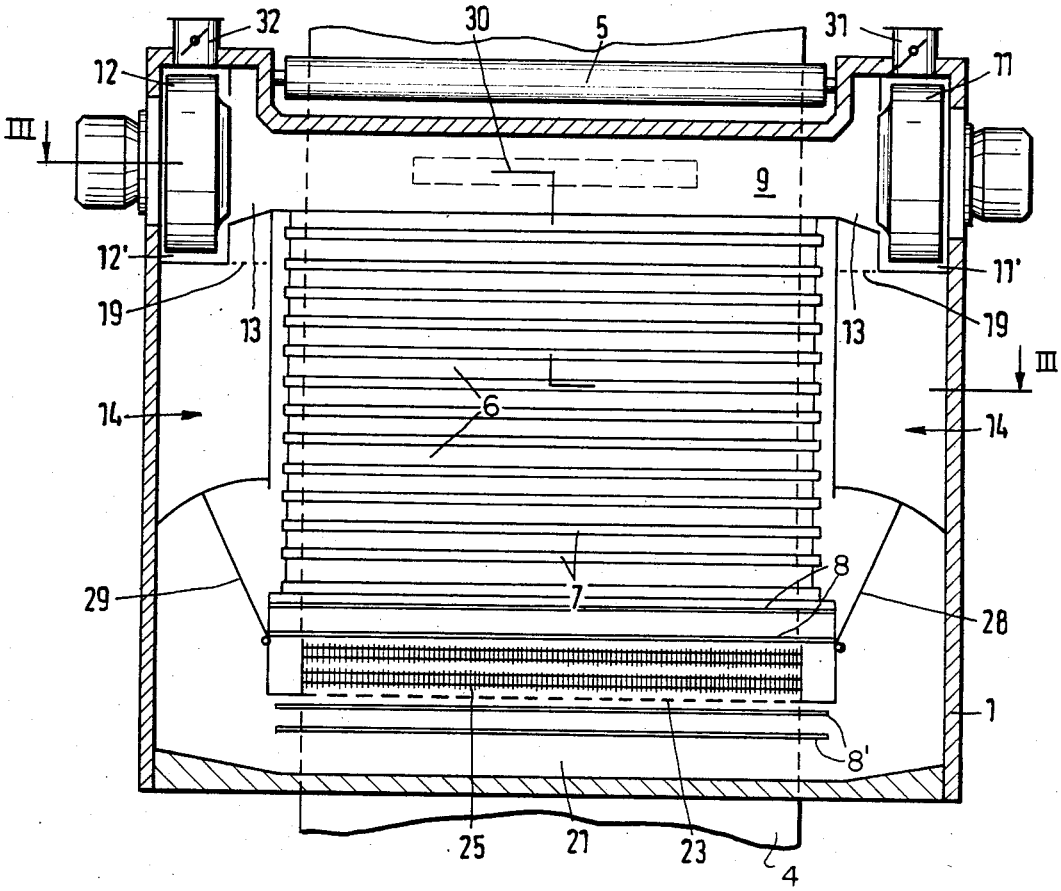
FIG. 2 shows the infrared drying tower according to FIG. 1 along section line II—II.
Figure 3:
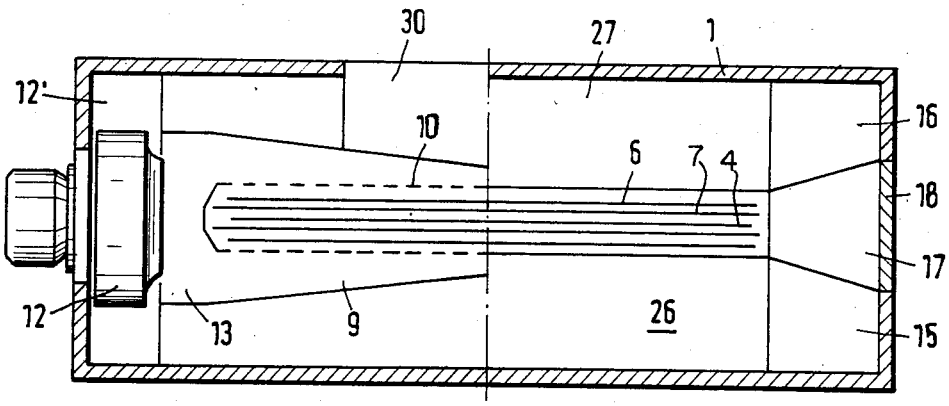
FIG. 3 shows, in partial section, a top view of the drying tower taken along section line III—III of FIG. 2.

As can be seen from FIG. 2, each air exhaust chamber 9 extends along the entire width of the drying tower and exhibits, at the end faces thereof, outside of the width of the length of material, respectively one radial-flow fan 11, 12, generating a vacuum in the air exhaust chamber 9. The air exhaust chambers 9 are disposed, according to FIG. 3, on both sides of the length 4 of material and together extend, in a conically flaring fashion, from the center of the drying tower to the fan intake chamber 13 wherein the two air exhaust chambers 9 terminate from both sides of the length of material.

As can be seen from FIG. 2, the fan intake chamber 13 is arranged even outside of the treatment width of the drying tower in the air recycle zone 14 provided at the front face of the drying tower. This air recycle zone 14 consists of two air recycle ducts 15, 16 which can be seen in a top view in FIG. 3. The air recycle ducts 15, 16 are located on the inside of the outer housing 1 and leave free space 17 between them, provided for free access to the actual drying zone in the drying tower, and being closed off from the outside by a door 18.

Above the air recycle zone 14, there are thus arranged the fan intake chamber 13 and the fans 11, 12 with the fan chambers 11', 12', and the air exhaust pipes 31, 32. The respective fan 11, 12 blows the air from above by way of a screen plate 19, also shown in FIG. 1, into the air recycle ducts 15, 16. The air recycle ducts 15, 16 during normal operation, are open along the entire cross section down to the bottom side of the drying tower. From the bottom side of the air recycle ducts 15, 16, the drying air then passes laterally via air inlet passages into the air ramming chambers 20, 21, defined in the upward direction by a sieve-like baffle plate 22, 23. Above the baffle plates 22, 23, the heating units 24, 25 are arranged which extend, just as the air ramming chambers 20, 21, over the entire width of the drying zone of the drying tower. On each side of the length 4 of material, the heating unit 24, 25 is respectively followed by the air conducting box 26, 27 feeding the heated-up treatment air to the slots 8. For a more uniform air distribution, the air conducting boxes 26, 27 are fashioned to be wide in the region of the heating units 24, 25, and to be narrow in the zone of the air recycle chambers 9, i.e. these wells taper conically in the upward direction.

According to FIG. 2, the two air recycle zones 14 on both sides of the drying tower are limited in their free throughflow cross section at the half point by a door 28, 29 that can be flipped open. This door is closed during operation of the device, i.e. it is vertically oriented. In case of a standstill of the length 4 of material, it is expedient to feed cooling air to the infrared heating rods 6 in place of heated-up circulated air. This is accomplished by swinging the doors 28, 29 open and passing the treatment air accelerated by fans 11, 12, immediately into the air conducting boxes 26, 27, while circumventing the heating devices 24, 25, and thus treatment air flows to the infrared heating rods 6 by way of the slots 8. At the same time, the shielding troughs 7 will be moved in front of the infrared heating rods 6 so that burning of the length of material is safely precluded.

As can be seen from FIG. 1, the treatment air circulated by fans 11, 12 flows into the treatment zone not only from the ramming chambers 20, 21 via the heating units 24, 25, but additionally also flows to the length of material 4 through slots 8' arranged underneath the heating devices 24, 25. Although this treatment air has not been recirculated through the heating device, it still has adequate heat for advantageously effecting the drying step and/or the removal of moist air.

It will be appreciated that appropriate heat sensors and travel detectors and associated control means (not shown) are provided to determine when the shielding troughs are to be moved in front or the heating rods 6 and the doors 28 and 29 are to be flipped open. Also appropriate means are provided for actuating these safety devices to insure that the length of material is not overheated during stopping or slow down.

What is claimed is:

1. A drying tower for the heat treatment of a vertically extending length of traveling material having a certain width, which comprises a housing having an inlet and an outlet through which the length of material is transported along a vertical path within a heat treatment zone; an air conducting box arranged on each side of the path for the length of material, each of said boxes having exhaust openings discharging in a direction toward the length of material traveling along said path; radial-flow fans for recirculating drying air and being associated with said air conducting boxes; infrared heating means arranged in said air conducting boxes on both sides of the path for the length of material and being vertically spaced from each other along a substantial portion of said path; each of the air conducting boxes extending on one side of the path for the length of material over a treatment height and over a treatment width of the heat treatment zone; a dry air inlet passage located at the bottom of each of said air conducting boxes; above each air conducting box, an air exhaust chamber located for receiving air discharged onto one side of the length of traveling material; and each of the radial-flow fans having an axis of rotation arranged in parallel to the width of the traveling material and being located in a fan chamber operatively associated with an end portion of each of said air exhaust chambers, and said fan chamber being arranged outside of the treatment width of said heat treatment zone in an air recycle zone provided at each lateral end portion of the drying tower and extending along the treatment height of the heat treatment zone within said tower for returning air to both sides of the path of the traveling length of material; the air recycling zone including two ducts associated with one of said radial-flow fans for supplying air on both sides of the path of the length of material.

2. A device according to claim 1, wherein each air exhaust chamber is associated with, respectively, one radial-flow fan on one of the end faces of the drying tower.

3. A device according to claim 2, wherein the two air exhaust chambers, respectively, one on each side of the path of the length of material, terminate outside of the treatment width into respectively only one fan intake chamber.

4. A device according to claim 2, wherein the air exhaust chamber is connected to a fresh air intake port.

5. A device according to claim 2, wherein one air exhaust chamber flares conically toward the fan intake chamber.

6. A device according to claim 1, wherein an air exhaust chamber is arranged on both sides of the path of the length of material, directly above the respective air conducting box.

7. A device according to claim 6, wherein the air exhaust chambers are open in the direction of a plane in which the length of material is traveling, and an air baffle means is provided at that location.

8. A device according to claim 1, wherein the air recycle ducts are arranged at a mutual spacing and adjacent to a housing wall located at a corner of the housing.

9. A device according to claim 8, wherein a closable opening is arranged in the center of the housing at an end wall, and the air recycle ducts are arranged laterally of said opening.

10. A device according to claim 1, wherein the air recycle ducts are covered at the top by a screen plate and terminate at the bottom laterally into the treatment zone of the drying tower.

11. A device according to claim 1, wherein a heating device extends over the cross section of each air conducting box over the treatment width in parallel to a drying air inlet opening at the air conducting box.

12. A device according to claim 11, wherein a ramming chamber is arranged underneath the heating device in parallel to the width of the heat treatment zone and is separated toward the top by a cover screen.

13. A device according to claim 12, wherein exhaust openings in the form of slots are likewise provided in a wall, delimiting the ramming chamber for discharging air toward the treatment zone.

14. A device according to claim 1, wherein exhaust openings of the air conducting box are fashioned as slots extending transversely over an operating width of the air conducting box.

15. A device according to claim 14, wherein the slots are inclined obliquely upwardly in the transport direction of the material.

16. A device according to claim 1, wherein a door extending over the depth of the air conducting box is formed at a respective air recycle duct above the heating device arranged in the treatment zone, in a wall leading to the air conducting box, said door swinging outwardly toward the top in the direction of the housing wall.

17. A device according to claim 1, wherein the air recycle chamber comprises two spaced apart ducts arranged on each side of the path of the length of traveling material and extending along the height of the housing for directing the air from a radial flow fan downwardly to the air inlet port at the bottom of each of said air conducting boxes.

18. A device according to claim 17, wherein said housing has a rectangular cross section and each of the air recycle ducts is arranged in one of the four corners of the housing.

19. A device according to claim 18, wherein each air recycle duct is provided with a door leading to an air conducting box, said door being operative in its closed position to allow the recycled air to enter into the air conducting box via a heater located near the dry air intake port and said door in its operative open position directing recycled air directly into the treatment zone surrounding the path of the length of material whereby damage caused by overheating of a length of traveling material during stoppage of the travel can be prevented.

20. A device according to claim 1, wherein a heating device is arranged to extend across the operating width of the heat treatment zone below the dry air inlet passage located at the bottom of each of said air conducting boxes for heating the air returned via said recycle ducts prior to entry of the air into the associated air conducting box.

* * * * *